United States Patent [19]

Milne

[11] 4,334,798

[45] Jun. 15, 1982

[54] METHOD OF FILLING A HOLE IN THE GROUND

[76] Inventor: James Milne, Stonegarth, Curthwaite, Wigton, Cumbria, England

[21] Appl. No.: 962,132

[22] Filed: Nov. 20, 1978

[51] Int. Cl.[3] ..... E01C 7/32

[52] U.S. Cl. ..... 404/75

[58] Field of Search ..... 404/75, 72, 81, 78

[56] References Cited

U.S. PATENT DOCUMENTS

| | | | |
|---|---|---|---|
| 138,710 | 5/1873 | Tall | 404/72 |
| 940,971 | 11/1909 | Howe | 404/81 |
| 1,717,445 | 6/1929 | Flood | 404/81 X |
| 1,915,032 | 6/1933 | Poulter | 404/78 |
| 1,945,145 | 1/1934 | Gordon | 404/75 |
| 2,041,266 | 5/1936 | Poulter | 404/78 |
| 2,101,388 | 12/1937 | Finley | 404/81 |
| 2,934,452 | 4/1960 | Sternberg | 404/75 X |
| 3,165,036 | 1/1965 | Schmidt | 404/81 X |

*Primary Examiner*—Nile C. Byers, Jr.

*Attorney, Agent, or Firm*—Buell, Blenko, Ziesenheim & Beck

[57] ABSTRACT

A hole in a road, airfield runway or in the ground is filled or partly filled by partly filling the hole with a plurality of separate bodies of concrete, rock or other solid material, and filling interstices between the separate bodies and wholly or partially filling the remaining space in the hole with a hardenable mixture of cold setting synthetic resin and filler, which hardenable mixture sets and bonds firmly to the surfaces of the separate bodies. Preferably, before the hardenable mixture is introduced, a flexible fluid—impermeable covering is applied over the partly-filled hole and is sealed to the surrounding ground surface to form a fluid-tight enclosure, and air is evacuated from the enclosure.

10 Claims, 4 Drawing Figures

METHOD OF FILLING A HOLE IN THE GROUND

Figure 1:
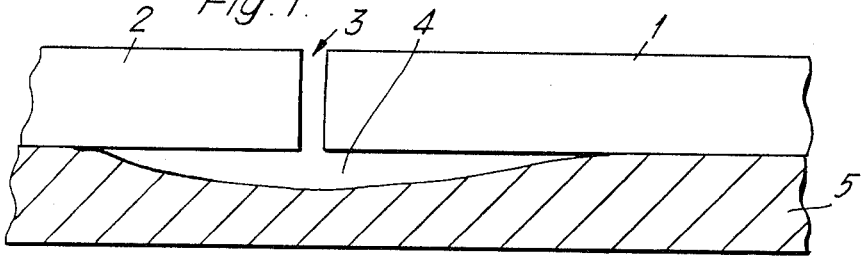

This invention relates to a method of filling or partly filling a hole in the ground.

The invention is especially, but not exclusively, applicable to holes in roads, airfield runways, car racing tracks, paths and other ground surfaces made wholly or in part of concrete; it is also applicable to holes formed during the construction of a building or the erection of an upstanding structure for foundation purposes.

It is an object of the invention to provide an improved method of filling or partly filling a hole in the ground, which method can be effected in substantially less time than methods hitherto proposed and used, is substantially more economical in materials than such methods and is therefore substantially cheaper.

According to the invention the method comprises partly filling the hole with a plurality of separate bodies of concrete or other material in its manufactured state and/or of rock, granite or other material in its natural state; substantially filling interstices between said separate bodies and wholly or partially filling the remaining space in the hole with a hardenable mixture of cold setting synthetic resin in a liquid or semi-liquid state and a filler; and permitting the hardenable mixture to set and bond firmly to the surfaces of said separate bodies.

Preferably, before introduction of the hardenable mixture, interstices between the separate bodies are partly filled with a coarse aggregate or other multiplicity of separate small bodies, the hardenable mixture then being introduced substantially to fill the remaining spaces in the interstices and wholly or partially fill the remaining space in the hole.

Since the hole is partly filled with separate bodies, or with separate bodies and coarse aggregate, the amount of hardenable mixture required to fill said interstices and wholly or partially fill the remaining space in the hole is substantially less than the amount of concrete in a plastic state that would otherwise have been required to fill the hole; the saving in cost of material can therefore be substantial. Furthermore, the hardenable mixture of cold setting synthetic resin and filler, unlike conventional concrete, effects a very strong bond with the separate bodies, and when present with the coarse aggregate, and will harden to a sufficient extent to support traffic or to permit construction work to commence in a few hours only.

Preferably, to ensure that the hardenable mixture not only substantially fills the interstices between the separate bodies but also enters cracks, pores, and other voids in the surfaces of said bodies, and when present of coarse aggregate, and thereby when it sets will effect a very strong bond with the bodies, and coarse aggregate, after the hole has been partially filled with separate bodies, or with separate bodies and coarse aggregate, it is closed by a flexible fluid-impermeable covering which is sealed to the surface of the ground around the hole to form a substantially fluid-tight enclosure; air and any other fluid is evacuated from the fluid-tight enclosure; said hardenable mixture is allowed to enter the evacuated enclosure until hardenable mixture substantially fills the interstices between the separate bodies and wholly or partially fills the remaining space in the hole; and the hardenable mixture is permitted to set.

Other operating steps that may be employed in introducing the hardenable mixture of cold setting synthetic resin and filler into the hole using the aforesaid vacuum impregnation technique are described and claimed in the specifications of my U.S. Pat. No. 4,060,953, British Pat. Nos. 1,479,020, 1,480,718 and 1,490,102, and of my co-pending U.S. applications Ser. Nos. 845,036 and 931,989.

To eliminate any risk that air will be introduced into the evacuated enclosure in the hardenable mixture, when preparing the mixture, the synthetic resin and filler may be mixed together under vacuum.

A preferred coarse aggregate is gravel because of its flow properties but, in some circumstances, stone or granite chippings may be employed.

It is preferred to use, as the cold setting synthetic resin, polyester resin because it has a very short setting time, usually about two hours, but in some circumstances where a short setting time is not of first priority, epoxy resin is preferred because there is less risk of cracks forming in the resin due to shrinkage of the resin as it hardens.

One preferred hardenable mixture comprises a synthetic resin/filler mixture in the proportion 1:1 to 2:1, by weight. A preferred hardenable mixture consists of 1 part by weight polyester resin and 1 part by weight calcite. Other fillers that may be employed include granular bauxite and armosphere, a material consisting of tiny hollow spheres of glass which are an extract of pulverised fuel ash.

As previously indicated, the method of the present invention is especially, but not exclusively, applicable to filling a hole in a road or other ground surface made wholly or in part of concrete. Where, in a road fabricated from separately formed slabs of concrete, a concrete slab cracks and a part or parts of the slab sinks or sink below the normal running surface of the road, it is the usual practice when repairing the road, to break up the damaged slab, to remove the pieces of broken concrete in order that the fault in the road foundation which caused the concrete slab to crack and sink can be identified, to repair the fault in the road foundation and to re-fill the resultant hole in the road with concrete in a plastic state which must then be allowed to harden. For several reasons such a method of road repair is extremely uneconomical and expensive. Firstly, during the time the road repair is being effected, traffic has to be diverted and apart from congestion and consequential delay to traffic this may entail employing police to control the diverted traffic and may cause considerable inconvenience to occupants of houses and other premises in the vicinity of the repair and/or diversion. Secondly, the broken pieces of concrete must be conveyed from the site of the road repair and sufficient concrete mixed on or transported to the site for filling the hole. Thirdly, after the hole has been filled with concrete time must be allowed for the concrete to harden to a sufficient extent for it to support traffic; this may take anything up to ten days and even longer, depending on the size and depth of the hole, the properties of the cement and the proportions of the mix. Thus, the usual method of effecting a road repair is extremely costly, not only in the amount of concrete employed, but also in the time necessary for a satisfactory repair to be made and for the road to become serviceable.

The method of the present invention is especially applicable to road repairs because it has the important advantages that the broken pieces of concrete slab originally forming a part of the road can constitute the separate bodies with which the hole is partly filled and therefore do not have to be conveyed from the site;

indeed in some circumstances after the sunken concrete slab has been broken into pieces, at least some of the pieces of concrete need not be removed from the road. Moreover, since the hardenable mixture of synthetic resin and filler hardens to a sufficient extent to support traffic in a few hours, the repair of a road can be effected in a matter of hours, say one night, as opposed to several days, thereby providing a considerable saving in expense and inconvenience.

Other applications of the method of the present invention include the fabrication of foundations for towers, masts, posts and other upstanding structures of the kind in which a lowermost part of a leg of a tower or mast or of a pole is positioned in a hole in the ground, that hitherto has been filled with concrete. By filling such a hole using the method of the present invention, there is not only a saving in material but the foundations so formed harden so quickly that further construction of a tower or other structure can continue within a matter of hours.

Figure 2:
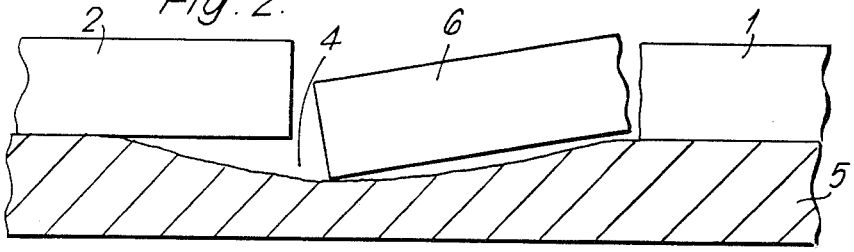
Figure 3:
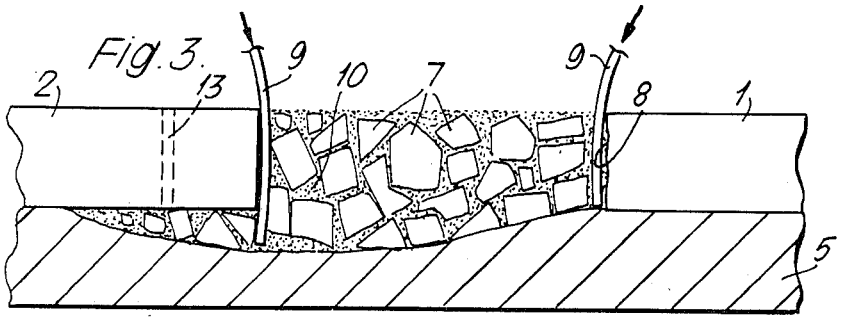
Figure 4:
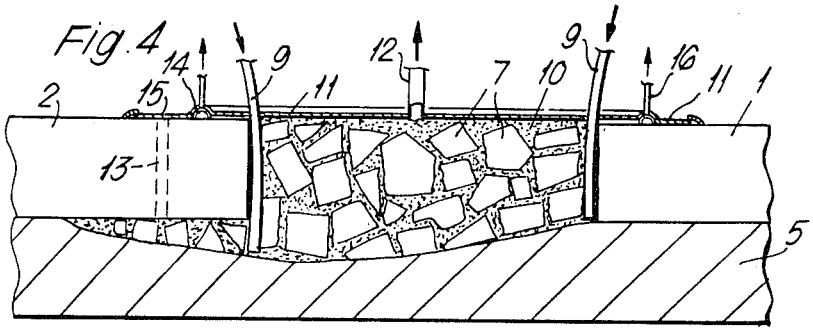

The invention will be further illustrated by a description, by way of example, of a preferred method of repairing a sunken part of a concrete road with reference to the accompanying drawing, in which:

FIG. 1 is a fragmental longitudinal section through a lateral joint between two concrete slabs of the road, FIG. 2 is a similar view in which one of the concrete slabs has fractured; and FIGS. 3 and 4 are stages in the method of repairing the road.

Referring to FIG. 1, the two concrete slabs 1, 2 of the lateral joint 3 are subject to a differential deflection on passage of heavy traffic due to the formation of a void 4 between the slabs and the sub-grade 5. Methods of introducing hardenable material into such a void in a road are the subject of my co-pending U.S. Patent applications Ser. Nos. 845,036 and 931,989.

In some circumstances before the voids can be satisfactorily filled with hardenable material, the traffic load is so large and the differential deflection becomes so great that actual fracture of the concrete slab 1 occurs with settlement of the broken portion 6 of the slab in the void, as shown in FIG. 2. As already described the current practice in repairing such a damaged road is to break the broken portion of concrete slab into pieces, remove these pieces from the site and, after repairing the fault causing the void, filling the space vacated by the broken portion of concrete slab with concrete in a plastic state.

In the method according to the present invention after breaking into pieces 7 of concrete the detached portion 6 of the slab 1 several of the pieces are removed to permit inspection of the foundation sub-grade 5 and, if necessary, to effect such repair as is required; pieces of concrete are then replaced in the hole 8 in such a way that all the pieces 7 lie below the plane of the road surface as shown in FIG. 3. Holes 13 are drilled through the slab 2 into the part of the void 4 underlying this slab. Several plastics tubes 9 that are to constitute injector nozzles are inserted around the periphery of the hole 8 in such a way that each penetrates deep down into the original void. The interstices between the pieces 7 of concrete are then partly filled with gravel aggregate 10, e.g. three-quarters of an inch or less, the aggregate being levelled off slightly below the original road level. As is shown in FIG. 4, a flexible fluid-impermeable polythene sheet 11 having one or more than one outlet 12 for connection to a vacuum pump (not shown) and having adjacent its boundary edges a separately formed preformed endless hollow wall 14 that has outlets 16 and that surrounds and opens towards and is sealed to, the part of the road immediately surrounding the hole 8, is fitted over the hole and over the drilled holes 13 and boundary edges of the sheet are sealed by mastic sealant or adhesive tape 15 to the road to form a substantially fluid-tight enclosure incorporating the hollow wall.

Air and any other fluid is then evacuated by a vacuum pump or pumps from the part of the void 4 underlying the slab 2 through the holes 13, from the hollow wall 14 and from voids within the covered part of the road through the outlets 12 and 16 and a hardenable mixture consisting of equal parts by weight of polyester resin and calcite is introduced through the injector tubes 9 until it oozes from the holes 13 and from the surface of the gravel aggregate 10 and forms a continuous surface, under the flexible sheet 11. Any air or other fluid that may leak under the sheet 11 from beyond its boundary edges enters the hollow wall 14 and is extracted through the outlets 16.

A small positive head of hardenable mixture is maintained on the injector tubes 9 until the hardenable mixture gels and then, before the hardenable mixture hardens, the injector tubes and flexible sheet 11 are removed and any holes left by extraction of the injector tubes are topped up with hardenable mixture. While the surface of the hardenable mixture is still tacky bauxite is sprinkled liberally over the hardenable mixture to provide an anti-skid surface. After approximately two hours the hardenable mixture will have bonded firmly to the surface of the pieces 7 and gravel aggregate 10 and will be hardened to a sufficient extent to support traffic.

What I claim as my invention is:

1. A method of at least partly filling a hole in the ground which comprises partly filling the hole with a plurality of separate bodies of solid material selected from the group consisting of concrete, rock, granite, stone and other manufactured and natural solid materials; applying over the partially filled hole a flexible fluid-tight impermeable covering and sealing the covering to the surface of the ground around the hole to form a substantially fluid-tight enclosure; evacuating air and any other fluid from the fluid-tight enclosure; allowing a hardenable mixture of cold setting synthetic resin in a flowable state and a filler to enter the evacuated enclosure until hardenable mixture substantially fills the interstices between said separate bodies and at least partially fills the remaining space in the hole; and permitting the hardenable mixture to set and bond firmly to the surfaces of said separate bodies.

2. A method as claimed in claim 1 and 7, wherein the fluid-impermeable covering has adjacent its boundary edges an endless hollow wall that surrounds the hole and opens towards the ground surface around the hole and that forms part of the fluid-tight enclosure and wherein air and any other fluid is also evacuated from the hollow wall, any air and other fluid leaking under the fluid-impermeable covering from beyond its boundary edges entering the evacuated hollow wall from where it is extracted.

3. A method as claimed in claim 1, wherein the synthetic resin and filler are pre-mixed under vacuum.

4. A method as claimed in claim 1, wherein the synthetic resin/filler mixture is in the proportions 1:1 to 2:1, by weight.

5. A method as claimed in claim 1, wherein the hole is in a road, airfield runway or other ground surface made at least in part of concrete.

6. A method as claimed in claim 1, wherein the lowermost part of a leg of a tower, or of a pole or of another upstanding structure is positioned in the hole before it is at least partly filled.

7. A method of at least partly filling a hole in the ground which comprises partly filling the hole with a plurality of separate bodies of solid material selected from the group consisting of concrete, rock, granite, stone and other manufactured and natural solid materials; partly filling interstices between the separate bodies with a multiplicity of separate small bodies of solid material; applying over the partially filled hole a flexible fluid-impermeable covering and sealing the covering to the surface of the ground around the hole to form a substantially fluid-tight enclosure; evacuating air and any other fluid from the fluid-tight enclosure; allowing a hardenable mixture of cold setting synthetic resin in a flowable state and a filler to enter the evacuated enclosure until hardenable mixture substantially fills the interstices between said separate bodies and at least partially fills the remaining space in the hole; and permitting the hardenable mixture to set and bond firmly to the surfaces of said separate bodies.

8. A method as claimed in claim 7, wherein the multiplicity of separate small bodies of solid material is coarse aggregate.

9. A method as claimed in claim 8, wherein the coarse aggregate is gravel.

10. A method as claimed in claim 8, wherein the coarse aggregate is stone or granite chippings.

* * * * *